United States Patent [19]

Wolowski et al.

[11] Patent Number: 4,675,102

[45] Date of Patent: Jun. 23, 1987

[54] PROCESS FOR PRODUCING A DIESEL FUEL FROM MEDIUM HEAVY OIL OBTAINED FROM COAL

[75] Inventors: Eckard Wolowski, Mülheim; Klaus-Dieter Dohms, Essen, both of Fed. Rep. of Germany

[73] Assignee: Ruhrkohle Aktiengesellschaft, Essen, Fed. Rep. of Germany

[21] Appl. No.: 739,141

[22] Filed: May 30, 1985

[30] Foreign Application Priority Data

May 30, 1984 [DE] Fed. Rep. of Germany ..... 3420197

[51] Int. Cl.[4] ..... C10G 1/00; C10G 1/06

[52] U.S. Cl. ..... 208/400; 208/415; 208/417; 208/424; 208/419

[58] Field of Search ..... 208/10

[56] References Cited

U.S. PATENT DOCUMENTS

| | | | |
|---|---|---|---|
| 3,700,584 | 10/1972 | Johanson et al. | 208/10 |
| 3,962,070 | 6/1976 | Stotlen | 208/10 |
| 4,018,663 | 4/1977 | Karr, Jr. | 208/10 |
| 4,094,760 | 6/1978 | Gorin | 208/10 |
| 4,111,788 | 9/1978 | Chervenak et al. | 208/10 |
| 4,113,602 | 9/1978 | Gorfoty et al. | 208/10 X |
| 4,125,452 | 11/1978 | Effron | 208/10 X |
| 4,132,627 | 1/1979 | Lear | 208/10 |
| 4,148,709 | 4/1979 | Sze | 208/10 |
| 4,162,963 | 7/1979 | Gorin | 208/10 X |
| 4,172,024 | 10/1979 | Simone et al. | 208/10 |
| 4,251,346 | 2/1981 | Dry et al. | 208/10 |
| 4,283,267 | 8/1981 | Moa et al. | 208/10 X |
| 4,299,685 | 11/1981 | Khulbe et al. | 208/10 X |
| 4,318,797 | 3/1982 | Jager et al. | 208/8 |
| 4,388,172 | 1/1983 | Rodewald et al. | 208/47 X |
| 4,409,092 | 10/1983 | Johnson et al. | 208/89 |
| 4,428,820 | 1/1984 | Kuehler et al. | 208/10 |
| 4,447,312 | 5/1984 | Angevine et al. | 208/46 |

*Primary Examiner*—Andrew H. Metz
*Assistant Examiner*—William G. Wright
*Attorney, Agent, or Firm*—Nils H. Ljungman

[57] ABSTRACT

The invention provides an improvement to a process for producing a diesel fuel from a medium heavy oil obtained from coal. The invention increases the amount of medium oil which can be used to produce diesel fuel while keeping the total yield of oil from the coal about the same. Thus, the fraction of the medium oil recovered is greater without altering the total yield of oil from the coal, and now amounts to about 80 to 85 percent of the total oil yield. Accordingly, the amount of light oil derived in this process becomes correspondingly smaller. Thus, the total oil yield is increased by about 4 to 6 percent compared with previously obtained results.

11 Claims, 1 Drawing Figure

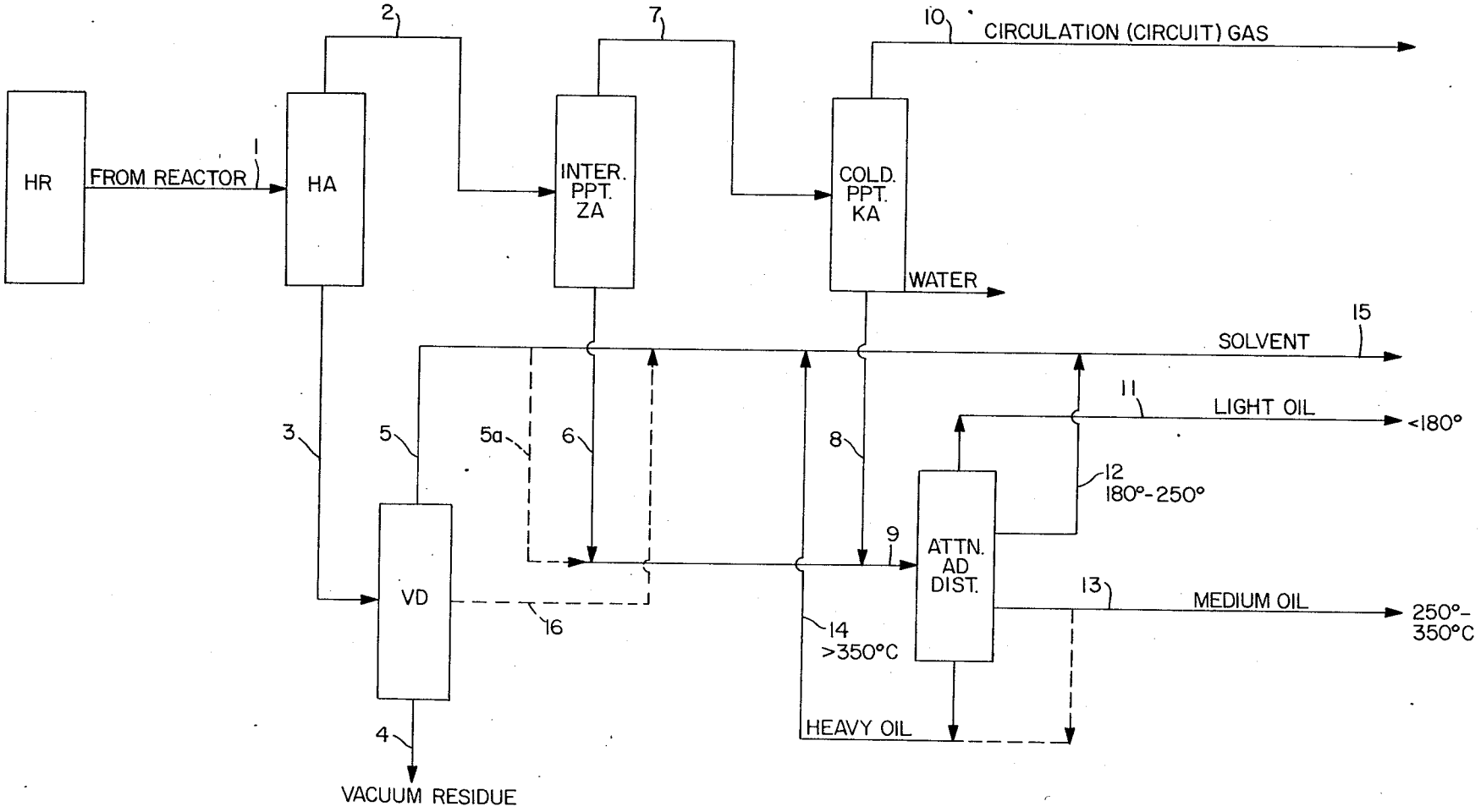
HR
FROM REACTOR
1
HA
2
INTER. PPT. ZA
7
COLD. PPT. KA
10
CIRCULATION (CIRCUIT) GAS
WATER
3
5
VD
4
VACUUM RESIDUE
5a
6
16
8
9
ATTN. AD DIST.
14
>350°C
HEAVY OIL
11
12
180°-250°
13
MEDIUM OIL
250°-350°C
15
SOLVENT
LIGHT OIL
<180°

PROCESS FOR PRODUCING A DIESEL FUEL FROM MEDIUM HEAVY OIL OBTAINED FROM COAL

BACKGROUND OF THE INVENTION

1. Field of the Invention

The invention generally relates to a process for the production of a diesel fuel. More particularly, the invention is directed to a process for increasing the amount of medium oil which can be used as a diesel fuel. Thus, the total oil yield is increased by about 4 to 6 percent compared with previously obtained results.

2. Description of the Prior Art

The present invention is directed to an improvement to a process for the production of diesel fuel in which the conventional process includes the steps in which a medium-grade oil obtained from coal is derived as a first runnings for the subsequent treatment in a refining and hydrocracking stage for the extraction of diesel fuel. The conventional process includes the hydrogenation of the coal in the presence of grinding oil which oil is obtained from the process, which also yields hydrogen-containing circuit gas and a finely divided catalyst or sump phase. The unliquefied solids are separated from the sump phase in a hot precipitator at about the same tempertures and pressures as in the liquefaction reactor, in which hydrogenation takes place. The vapor-form head product of the hot precipitator is condensed in an intermediate and a cold precipitator which takes place with the simultaneous recovery of the circulation gas. The aforedescribed conventional process produces a light oil which boils below 200° C. and a medium oil as a first batch runnings, which boils between 200° and 325° C., as well as a grinding oil.

The above-outlined conventional process has associated therewith several drawbacks. Particularly, only 65 to 70 percent of the entire oil yield from the coal consists of the medium oil which is used to produce diesel fuel. As a result of the further processing of the medium oil to produce a diesel fuel, there is produced appreciable fractions, namely 60 to 65 percent of the products which boil below 185° C. and which are no longer suitable for use in diesel engines.

Some examples of the refining processes are: U.S. Pat. No. 4,447,312, which relates to a process for preparing diesel fuel from coal-derived light fuel oils; U.S. Pat. No. 4,409,092, which describes a combination process for upgrading hydrocarbon fractions obtained from oil products of coal processing; and U.S. Pat. No. 4,318,797, in which the invention provides a process and an apparatus for hydrogenative liquefaction of coal to produce high yields of gasoline fraction, and optional yields of diesel and residue fraction, all of superior quality. All of the afore-mentioned patents are incorporated herein by reference. U.S. Pat. No. 4,251,346, also incorporated herein by reference, describes a process for coal liquefaction. The comminuted coal is slurried in a solvent or pasting oil and digested, normally under hydrogen pressure and catalytic conditions. The solvent or pasting oil is obtained wholly or mostly by recycling from the distilled fractionation of the reaction products. Additionally, U.S. Pat. No. 4,018,663, also incorporated herein by reference, relates to an improved coal liquefaction process which enables conversion of a coal-oil slurry to a synthetic crude refinable to produce larger yields of gasoline and diesel oil. The process is characterized by a two-step operation applied to the slurry prior to catalytic desulfurization and hydrogenation, in which the slurry undergoes partial hydrogenation to crack and hydrogenate asphaltenes, and the partially hydrogenated slurry is filtered to remove minerals prior to subsequent catalytic hydrogenation.

OBJECT OF THE INVENTION

It is therefore an object of this invention to increase the fraction or amount of medium oil produced in the aforedescribed process while keeping the total yield of oil from the coal substantially the same. This yield is typically about 50 percent, based on water-free and ash-free coal. In particular, this invention has as its object the provision of an improved process in which the amount of medium oil which can be used as a diesel fuel is increased.

SUMMARY OF THE INVENTION

This invention provides an improvement to a known process for producing a diesel fuel from medium heavy oil obtained from coal, and includes the step of feeding the condensate from the intermediate and the cold precipitator to a distillation column operating under atmospheric pressure to provide four separate fractions. The first fraction boils below approximately 180° C., the second fraction boils between about 180° and 250° C., the third fraction boils between about 250° and 350° C., and the fourth fraction boils above 350° C. The first fraction is used as a light coal oil to be processed further. The second and the fourth fractions are used as a grinding oil. The third fraction is used as the first runnings for the subsequent reprocessing with the extraction of diesel fuel. Thus, the total oil yield is increased by about 4 to 6 percent compared with previously obtained results using the conventional process.

Accordingly, the invention provides a process in which the yield of the medium oil recovered from the intermediate precipitator and the cold precipitator is raised, by comparison with the conventional techniques utilized. This process lowers the boiling point of the simultaneously recovered light oil. The intermediate fraction obtained by this step, i.e., the second fraction, with a boiling temperature of between about 180° and 250° C. and the light oil are fed back or recirculated as a component of the grinding oil. The highest boiling point fraction, an important component of the grinding oil, is used in the hydrogenation process of the coal.

BRIEF DESCRIPTION OF THE DRAWING

The above, as well as other features and advantages of the present invention, can be appreciated through consideration of the detailed description of the invention in conjunction with the sole FIGURE which is a schematical representation of the equipment utilized to effect the process of this invention.

DESCRIPTION OF THE PREFERRED EMBODIMENT

The improved process of this invention is schematically represented in the sole FIGURE, in which a product stream 1 from the coal hydrogenating reactor HR is separated in the hot precipitator HA into a head stream 2 and a sump stream 3. The sump stream 3 is separated in a vacuum distillation plant or flash vacuum distillation plant VD firstly into a vacuum residue stream 4, comprising coal, ashes, catalyst, asphalts, and high boiling point oils, and secondly, into a head stream 5 which comprises a distillate oil which boils between about 200° and 450° C. This distillate oil is added to the grinding oil or solvent to be utilized in the coal hydrogenation process.

After being cooled to about 250° to 300° C., the head stream 2 from the hot precipitator HA is partially condensed in an intermediate precipitator ZA. The condensate is fed as a stream 6 to the distillation column AD which operates under atmospheric pressure. After cooling to about 20° to 40° C., the head stream 7 is condensed in a cold precipitator KA. After the condensate is freed of water, the condensate is fed as a stream 8, together with the stream 6, and a combined stream 9 to the distillation column AD which is operating under atmospheric pressure. The head stream 10 of the coal precipitator KA is fed as circuit gas to a high-pressure washer or scrubber, and then fed back again to the hydrogenating reactor HR. The stream 9 is decomposed in the distillation column AD, which is working under atmospheric pressure, into the four boiling fractions of this process. The first fraction has a boiling temperature of less than 180° C. and is indicated as stream 11. The second fraction has a boiling temperature of between about 180° and 250° C., and is indicated as stream 12. The third fraction has a boiling temperature of between about 250° and 350° C., and is indicated as stream 13. The fourth fraction has a boiling temperature greater than approximately 350° C., and is indicated as stream 14. Streams 12 and 14, together with stream 5, are fed as the total required grinding oil at stream 15 into the hydrogenation process. The temperatures in the hydrogenating reactor HR are between about 450° to 500° C. The pressures in the hydrogenating reactor, the hot precipitator, the intermediate precipitator, as well as in the cold precipitator, preferably are between 150 and 350 bars.

EXAMPLE

The following investigation was carried out in an installation described in association with the flow diagram:

From 22,458 kg of reaction product from the hydrogenating reactor (stream 1), the following distribution is obtained in the hot precipitator HA, which is normally operated between 400° and 480° C., and preferably at a temperature of 450° C.:

At the head of the hot precipitator HA there is produced, as stream 2, 16,491 kg of hydrocarbon gas at a temperture of up to 450° C. Boiling distillate oils therefrom are partially condensed in the intermediate precipitator ZA at a temperature of 250° to 300° C. The major part of the condensate from the intermediate precipitator ZA (4,396 kg, stream 6) comprises medium and heavy oil with small amounts of light oil (about 5%). The head product from the intermediate precipitator ZA (12,095 kg, stream 7) comprises 9,075 kg $C_1$–$C_4$ hydrocarbon gases along with $H_2S$ and $NH_3$ which are carried off as stream 10 in the cold precipitator KA as a head product at a temperature of about 20° C. while, simultaneously, 2,727 kg of light and medium oil, as well as 293 kg of water, are carried off as condensate (stream 8) from the cold precipitator KA.

Stream 6 from the intermediate precipitator ZA and stream 8 from the cold precipitator KA are carried away together (7,123 kg, stream 9) and decomposed at normal pressure in the distillation column AD. In the process, there is produced, as stream 11: 548 kg of light oil having a boiling point below 180° C., as stream 12: 1,100 kg of medium oil having a boiling point between 250° and 350° C., as well as stream 14: 3,273 kg having a boiling point above 350° C.

In the hot precipitator HA there is produced, as stream 3: 5,967 kg of non-liquified sump product which is decomposed in the vacuum distillation plant VD into 2,090 kg vacuum residue (stream 4) and 3,877 kg of head product (stream 5). Stream 5 is a constituent of stream 15 which contain together 8,250 kg and serve conjointly as grinding oil. The mode of operation of the vacuum distillation plant VD can be modified in that, instead of stream 5, a head stream **5*a* can be led off along with a stream 16. Stream 16, in addition to stream 4, is taken from a middle offtake in the vacuum distillation plant VD. The distillate oil taken off as stream 16 from the middle offtake in the vacuum distillation plant VD preferably boils above 350° C. and is preferably exclusively conjointly employed as grinding oil. At the same time, the boiling range of the head product from the vacuum distillation plant VD (stream 5*a*) lies between 180° and 350° C. The stream 5*a* is still fed into the input stream 9** of the distillation column AD which is operating under atmospheric pressure.

The amounts of medium oil and the yields of diesel fuel additionally mentioned above are obtained by means of this mode of operation, in the process of which the further treatment of the medium oil used as a first runnings in a refining and hydrocracking stage is carried out with the recovery, in known manner, of the diesel fuel.

What has been described is an improved process for use in producing diesel fuel from a medium heavy oil derived from coal in which the yield of medium oil which can be further processed into diesel fuel is improved, thus ensuring an increase in the grinding oil fed back into the hydrogenating process. The improved process of this invention is not subject to any particularly exceptional conditions such as pressure, temperature and other parameters, so that known usage criteria can find unrestricted application in the field of this invention.

The invention as described hereinabove in the context of a preferred embodiment is not to be taken as limited to all of the provided details thereof, since modifications and variations thereof may be made without departing from the spirit and scope of the invention.

What is claimed is:

1. An improvement to a process for manufacturing a diesel fuel, in which a medium grade oil obtained from coal is derived as a first runnings for subsequent treatment thereof in a refining and hydrocracking stage for the extraction of diesel fuel through the steps of hydrogenating coal in the presence of grinding oil, obtained from the process, hydrogen-containing circuit gas and a finely divided catalyst which conventional process includes:

a separation of the unliquefied solids from the sump phase in a hot precipitator (HA) at about the same temperatures and pressures as in a liquefaction reactor; and condensation of a vapor-form head product (2) of said hot precipitator (HA) in an intermediate precipitator (ZA) and a cold precipitator (KA) with the simultaneous recovery of the circulation gas (10), the improvement to the aforesaid conventional process consisting essentially of the step of:

feeding said condensate (6–8) from said intermediate precipitator (ZA) and said cold precipitator (KA)

to a distillation column (AD) operating under atmospheric pressure to provide a first fraction (11) boiling below about 180° C. for use as a light oil for further processing, a second fraction (12) boiling between about 180° and 250° C. for use as a grinding oil, a third fraction (13) boiling between about 250° and 350° C. for use as a first runnings for the subsequent reprocessing thereof with the extraction of diesel fuel, and a fourth fraction (14) boiling above about 350° C. for use as a grinding oil.

2. The improved process according to claim 1 wherein the liquid and solid sump products which accumulate in said hot precipitator are subsequently treated in a vacuum distillation plant with the recovery of additional grinding oil therefrom.

3. The improved process according to claim 2 including the step of recovering a head product from said vacuum distillation plant, said recovered head product having a boiling temperature below 350° C., wherein said recovered head product, together with said condensate from said intermediate and said cold precipitator, is fed to said distillation column which operates under atmospheric pressure.

4. The improved process according to claim 2 including the step of recovering an intermediate product which boils at above about 350° C. and which is used as an additional grinding oil, said recovered intermediate product being recovered in said vacuum distillation plant.

5. An improvement to a process for manufacturing a diesel fuel, in which a medium grade oil obtained from coal is derived as a first runnings for subsequent treatment thereof in a refining and hydrocracking stage for the extraction of diesel fuel through the steps of hydrogenating coal in the presence of grinding oil, obtained from the process, hydrogen-containing circuit gas and a finely divided catalyst which conventional process includes:

a separation of the unliquefied solids from the sump phase in a hot precipitator at about the same temperatures and pressures as in a liquefaction reactor; and condensation of a vapor-form head product of said hot precipitator in an intermediate precipitator and a cold precipitator with the simultaneous recovery of the circulation gas, the improvement to the aforesaid conventional process consisting essentially of the steps of:

feeding said condensate from said intermediate and said cold precipitator to a distillation column operating under atmospheric pressure to provide a first fraction boiling below about 180° C. for use as a light oil for further processing, a second fraction boiling between about 180° and 250° C. for use as a grinding oil, a third fraction boiling between about 250° and 350° C. for use as a first runnings for the subsequent reprocessing thereof with the extraction of diesel fuel, and a fourth fraction boiling above about 350° C. for use as a grinding oil; and treating the liquid and solid sump products which accumulate in said hot precipitator in a vacuum distillation plant, wherein additional grinding oil is recovered therefrom.

6. The improved process according to claim 5 including the step of recovering a head product from said vacuum distillation plant, said recovered head product having a boiling temperature below 350° C., wherein said recovered head product, together with said condensate from said intermediate and said cold precipitator, is fed to said distillation column which operates under atmospheric pressure.

7. The improved process according to claim 5 including the step of recovering an intermediate product which boils at above about 350° C. and which is used as an additional grinding oil, said recovered intermediate product being recovered in said vacuum distillation plant.

8. An improvement to a process for manufacturing a diesel fuel, in which a medium grade oil obtained from coal is derived as a first runnings for subsequent treatment thereof in a refining and hydrocracking stage for the extraction of diesel fuel through the steps of hydrogenating coal in the presence of grinding oil, obtained from the process, hydrogen-containing circuit gas and a finely divided catalyst which conventional process includes:

a separation of the unliquefied solids from the sump phase in a hot precipitator at about the same temperatures and pressures as in a liquefaction reactor; and condensation of a vapor-form head product of said hot precipitator in an intermediate precipitator and a cold precipitator with the simultaneous recovery of the circulation gas, the improvement to the aforesaid conventional process consisting essentially of the steps of:

feeding said condensate from said intermediate and said cold precipitator to a distillation column operating under atmospheric pressure to provide a first fraction boiling below about 180° C. for use as a light oil for further processing, a second fraction boiling between about 180° and 250° C. for use as a grinding oil, a third fraction boiling between about 250° and 350° C. for use as a first runnings for the subsequent reprocessing thereof with the extraction of diesel fuel, and a fourth fraction boiling above about 350° C. for use as a grinding oil;

treating the liquid and solid sump products which accumulate in said hot precipitator in a vacuum distillation plant, wherein additional grinding oil is recovered therefrom;

recovering a head product from said vacuum distillation plant, said recovered head product having a boiling temperature below 350° C., wherein said head product together with said condensate from said intermediate and said cold precipitator are fed to said vacuum distillation column which operates under atmospheric pressure; and recovering an intermediate product which boils above about 350° C. and which is used as an additional grinding oil, said recovered intermediate product being recovered in said vacuum distillation plant.

9. The process according to claim 3 wherein the boiling temperature of said recovery head product lies between 180° and 350° C.

10. The process according to claim 6 wherein the boiling temperature of said recovery head product lies between 180° and 350° C.

11. The process according to claim 8 wherein the boiling temperature of said recovery head product lies between 180° and 350° C.

* * * * *